United States Patent [19]

Wienstroth

[11] 4,366,417

[45] Dec. 28, 1982

[54] SUPPRESSION CIRCUIT FOR INTERFERENCE PULSES IN TRANSFORMERS WITH HIGH LEAKAGE INDUCTANCE

[75] Inventor: Volker Wienstroth, Weilburg-Kubach, Fed. Rep. of Germany

[73] Assignee: Ernst Leitz Wetzlar GmbH, Wetzlar, Fed. Rep. of Germany

[21] Appl. No.: 63,099

[22] Filed: Aug. 2, 1979

[30] Foreign Application Priority Data

Aug. 12, 1978 [DE] Fed. Rep. of Germany ..... 2835379

[51] Int. Cl.[3] ..... H05B 39/08

[52] U.S. Cl. ..... 315/296; 315/198; 315/245; 315/255; 315/322; 353/85

[58] Field of Search ..... 315/85, 195, 198, 245, 315/255, 257, 296, 322; 307/12, 17, 30, 32; 323/215, 217; 353/85, 86

[56] References Cited

U.S. PATENT DOCUMENTS 3,564,334 2/1971 Wright ..... 315/322 X 4,080,551 3/1978 Heiland et al. ..... 315/296

*Primary Examiner*—Eugene R. LaRoche

*Attorney, Agent, or Firm*—Schwartz, Jeffery, Schwaab, Mack, Blumenthal & Koch

[57] ABSTRACT

A circuit for suppressing interference pulses occurring in transformers with high leakage inductance. The circuit includes current controlled switches connected to the transformers having secondary windings. The switches are controlled by a trigger circuit and a control device. The interference pulses are suppressed by a pulse suppression circuit connected between the secondary windings of the transformers and the trigger circuit. Furthermore the transformers' secondary windings are interconnected in phase to the pulse suppression circuit. The correct interconnection is controlled and/or indicated.

7 Claims, 6 Drawing Figures

Fig. 1
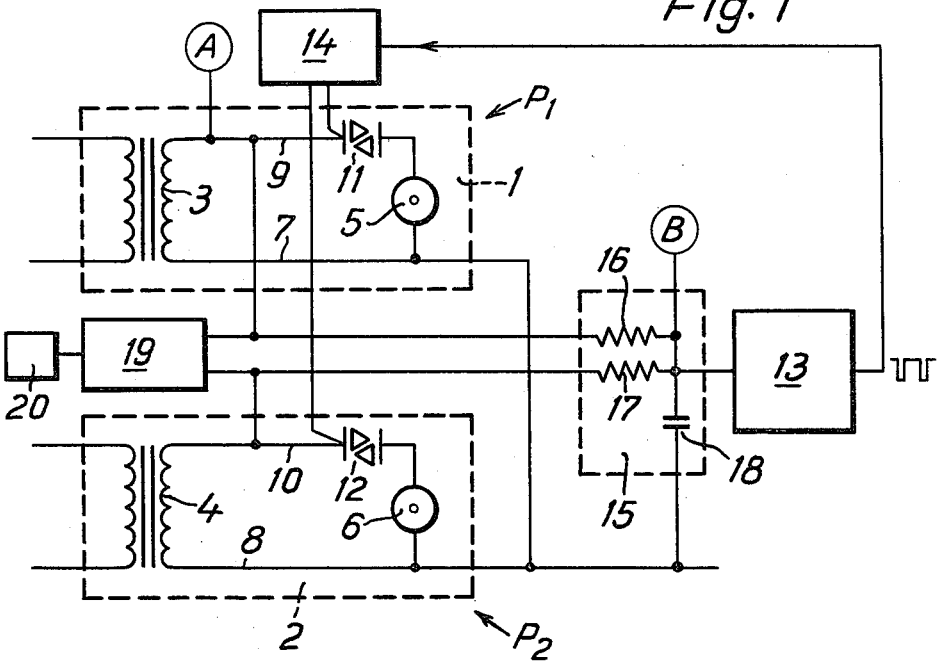
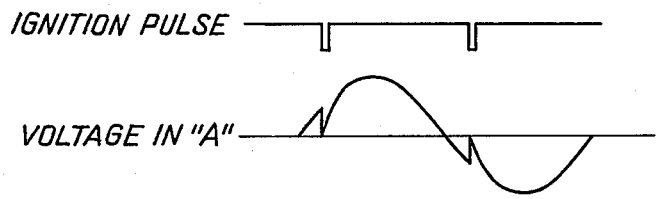
Fig. 2
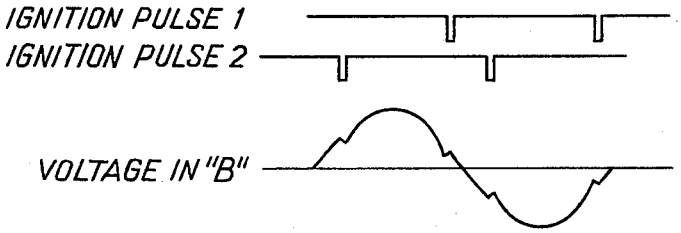
Fig. 3
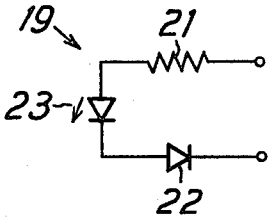
Fig. 4

SUPPRESSION CIRCUIT FOR INTERFERENCE PULSES IN TRANSFORMERS WITH HIGH LEAKAGE INDUCTANCE

BACKGROUND OF THE INVENTION

1. Field of the Invention

The invention concerns a circuit for the suppression of interference pulses in transformers with a high leakage inductance. The transformers may typically supply a single consumer each by means of current controlled switches.

2. Description of the Prior Art

Suppression circuits are required for example in change-over control devices for slide projectors. It is known that change-over control devices may contain current controlled switches, such as TRIACs, which must be reignited after every voltage half-wave by means of a trigger, utilizing a control device. To generate these ignition pulses, the control device has its own transformer mains to supply the power.

However, it is sometimes desirable for reasons of simplification to supply the control devices from the illumination transformer already present in a projector. In such cases it is possible that interference pulses present at the instant of the switch ignition at the secondary winding of the transformer and caused by the high leakage inductance due to the particular design of most of these transformers, will actuate the trigger at the wrong time, thus significantly interfering with the synchronization of the control device.

Because such an interference pulse is capable of collapsing the secondary voltage to 0 volts, a simple filtering of the pulse by means of an RC element does not provide adequate suppression of the interference. Such a suppression is more critical the closer the interference pulse is located to the zero crossing of the alternating current voltage.

SUMMARY OF THE INVENTION

It is therefor an object of the invention to provide a suppression circuit so that a true sine wave voltage is fed from the secondary winding of the transformer to the input of the trigger without interference pulses.

Because a change-over control for slide projectors comprises at least two such devices with their brightness opposingly regulated, the object of the invention is attained by connecting the secondary windings of the two transformers with the input of the trigger device by means of a common suppressor element. The output signals of the trigger device are fed to a control device actuating current controlled switches.

The result is that the ignition pulses for the two current controlled switches, except exactly at the apex of the sinusoidal voltage curve, never coincide in time as the pulses are countercurrently varied (the ignition time for the darkening projector is reducing until zero percent and is increasing until 100 percent for the brightening projector; at the apex of the sinusoidal voltage curve the ignition time will be 50 percent for both transformers). Thus an undisturbed voltage is always available from one of the transformers.

The interference pulse still existing at the apex of the voltage curve is readily smoothed by means of the common suppressor element, because at this point in time the secondary voltage assumes its maximum value. It is proposed in keeping with the invention to provide at least one resistance and a condenser in the suppressor element per transformer.

The circuit arrangement may be designed so that the lower points of the secondary windings of the two transformers are interconnected, the upper points of the secondary windings of the two transformers containing the current controlled switches are interconnected by means of a first and a second resistance, that a common condenser is arranged between the point of junction of the resistances and the point of junction of the lower points of the secondary transformers and that the voltage generated at the condenser controls the trigger stage.

In a further embodiment of the circuit the control device has a retardation adjustability which is separately available for the two current controlled switches.

The suppression technique described heretofore assumes that the phase position of the secondary voltages is the same, because in the case of opposing phase positions and resistances of equal magnitude, the voltages cancel each other in the suppression circuit and the trigger would emit no switching signal. In order to eliminate errors of this nature, means to control the instantaneous phase position of the alternating current voltage supplied to the secondary windings of the transformers are provided. It is of advantage to provide means to indicate correct and incorrect phase positions.

BRIEF DESCRIPTION OF THE DRAWINGS

The invention will be described hereinafter with the aid of a schematically represented example of embodiment. In the drawing:

FIG. 1 shows a circuit diagram of the layout according to the invention,

FIG. 2 is a diagram of the voltage curve in (A) of FIG. 1,

FIG. 3 is a diagram of the voltage curve in (B) of FIG. 1,

FIG. 4 is a display device for phase control,

DETAILED DESCRIPTION OF THE PREFERRED EMBODIMENT

Figure 6:
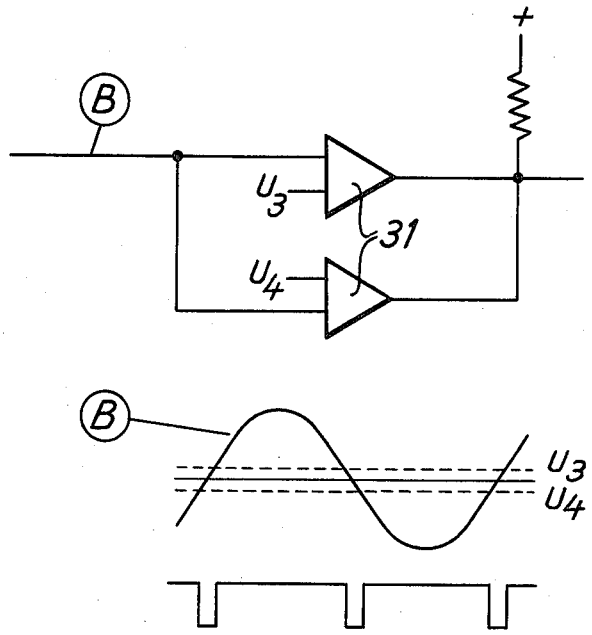
FIG. 6 shows an example of a circuit diagram of the trigger circuit used in the invention and the pulse resulting therefrom.

The circuit arrangement according to the invention is illustrated in FIG. 1 by means of a change-over control device for two slide projectors $P_1$ and $P_2$ (indicated by broken lines), the projection lamps 5 and 6 of which shall be alternatingly switched on and out respectively. The changing-over from one lamp to the other one shall be continuously performed (average time for changing-over about 5 sec). Thatfor the two transformers 1 and 2 are shown, each supplied by a power source (not shown). Projection lamps 5 and 6 are connected with secondary windings 3 and 4, respectively, of the transformers 1 and 2.

The slide projectors are combined in a functional unit by interconnecting the lower points 7 and 8 directly and the upper points 9 and 10 of the secondary windings 3 and 4 of the transformers 1 and 2 by way of the resistances 16, 17.

The brightness of the projection lamps 5 and 6 is oppositely regulated by current controlled switches 11 and 12, which are connected preceding their respective projection lamps and in series therewith. These switches are actuated by means of a trigger circuit 13 and a control device 14 having pulse retardation means for permitting separate adjustable control of the current controlled switches 11 and 12, e.g. by means of separate trigger pulses.

Figure 5:
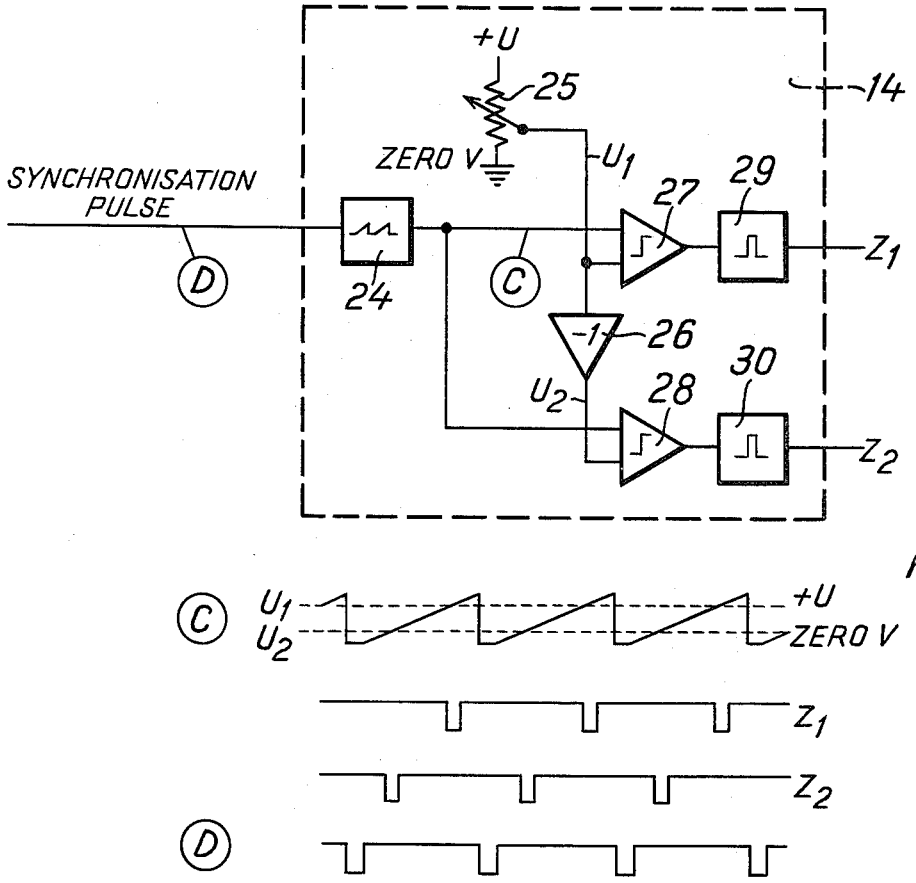
FIG. 5 is an example of a control device according to the invention and the ignition pulses resulting therefrom.

Trigger circuits and control devices as used in the invention are well known in the art. An example each of their structures is given in FIG. 5 and 6 and the performance of their elements is described hereinafter.

The control device used in the present invention is composed of a ramp voltage generator 24, a potentiometer 25 acting as fading control, an inverter 26, comparators 27, 28, and monostable sweep stages 29, 30.

The control device described above is functioning as follows: The ramp voltage generator 24 triggered by a synchronization pulse D, occuring once at each zero crossing of the main alternating voltage, transmits a linearly increasing output signal C (ramp voltage) to the comparators 27, 28. The monostable sweep stage 29 connected in series to comparator 27 generates an ignition pulse $Z_1$ to the current controlled switch 11 after being supplied with a signal from comparator 27, which is generated when the ramp voltage C exceeds voltage $U_1$ provided by potentiometer 25 and supplied to comparator 27.

The inverter 26, the inlet of which is connected to potentiometer 25 and the outlet of which is connected to comparator 28, inverts voltage $U_1$ in a manner that its output signal equals $U-U_1$.

The monostable sweep stage 30 controlled by the output signal of comparator 2 generates an ignition pulse $Z_2$ to the current controlled switch 12 when ramp voltage C exceeds voltage $U_2$.

Upon adjusting potentiometer 25 the point of time of the ignition pulses $Z_1$ and $Z_2$ is counter-currently alternated, as the voltages $U_1$ and $U_2$ are countercurrently alternating. The potentiometer 25 acting as fading control may be replaced by an electronic circuit to attain for instance an automatic change-over.

The trigger circuit 13 may be depicted by a window comparator 31 shown in FIG. 6. Window comparators are well known in the art. They only are generating output signals if the input voltage is not exceeding or passing below a given value. Such value is represented in FIG. 6 by the voltages $U_3$ and $U_4$ respectively. Both being adjustable and determining the width of the window comparator and therefore the width of the pulses as well. After the fixing of the current controlled switch 11 by pulses generated of control device 14, switch 11 produces pulses interfering the secondary voltage of the transformers and collapsing the same to zero as shown by the diagram of the voltage curve of FIG. 2.

Since trigger circuit 13 is generating pulses upon voltage curve's zero crossing, additional yet unwanted pulses occur. Such additional pulses cause interferences in control device 14.

To suppress such interference pulses present at the point in time at the secondary windings 3 and 4 of the transformers 1 and 2, for example in A of FIG. 1, a suppressor element 15 is provided within the circuit. The suppressor element 15 comprises a first resistance 16 and a second resistance 17, together with a condenser 18. Within the circuit, the layout has a configuration such that the upper points 9 and 10 of the secondary windings 3 and 4 are interconnected by way of the resistances 16 and 17 and that the condenser 18 is located between the junction point of the resistances 16 and 17 and the junction point of the lower points 7 and 8 of the transformers 1 and 2. The suppression of the interference pulses obtained in this manner, at point B of FIG. 1, results in a voltage curve as shown in the diagram of FIG. 3. Therefrom can be seen, that suppressor element 15 is suppressing the unwanted peaks of the voltage curve of both of the transformers, which are depicting a pseudo-zero crossing of the voltage curve. According to such suppression, the voltage curve in B of FIG. 1 will have a configuration as shown in FIG. 3. Thus, only a real zero crossing of the voltage curve will cause trigger circuit 13 to transmit pulses to control device 14.

Because this suppression measure presupposes the existence of identical phases of the secondary voltages, a suitable test and display device is advantageous. In the example shown, a phase control 19 with a display 20 is connected to the upper points 9 and 10 of the secondary windings 3 and 4 and before the resistances 16 and 17. The phase control may comprise, for example, as shown in FIG. 4, a resistance 21, a diode 22 and a light emitting diode 23. The latter lights up, when the phases of the supply voltages of the transformers do not coincide. This defect may be eliminated by reversing the poles of one of the transformers. The light emitting diode 23 is then extinguished.

It is obviously also possible to design the display so that the light emitting diode lights up when the phases of the supply voltages of the transformers coincide.

Although this invention has been described with respect to a specific embodiment, it is to be understood that the invention is not restricted thereto but covers any and all modifications and changes which may be made within the scope of the appended claims.

The suppression circuit described hereinabove overcomes the drawbacks of the prior art by being interconnected to the outputs of both secondary windings of the transformers.

What is claimed is:

1. A circuit for the suppression of interference pulses in at least first and second transformers having high leakage inductances and having first and second current controlled switches connected to said transformers, said first transformer havin a first secondary winding and said second transformer having a second secondary winding, said current controlled switches controlled by a trigger circuit and a control device connected thereto, said suppression circuit comprising:

(a) pulse suppression means connected between said secondary windings and said trigger circuit, and (b) means for interconnecting said two transformers secondary windings in phase to said pulse suppression means.

2. A suppression circuit as recited in claim 1 wherein said pulse suppression means comprises at least one resistor and a condenser.

3. A suppression circuit as recited in claim 1 wherein said pulse suppression means comprises:

(a) a condenser, (b) a first and second resistor, (c) means for connecting a side of said first resistor to a side of said first secondary winding, and a side of said second resistor to a corresponding side of said second secondary winding, (d) means for connecting the other side of said first and second resistors together and to one side of said condenser, (e) means for connecting the other side of said condenser to another side of said first and second secondary windings, and (f) means for connecting said condenser to said trigger circuit for triggering same.

4. A suppression circuit as recited in claim 1 or 3 wherein said control device comprises means for separately adjusting the firing of said first and second current controlled switches.

5. A suppression circuit as recited in claim 1 further comprising means for controlling the instantaneous phase position of AC voltage supplied to said first and second secondary windings.

6. A suppression circuit as recited in claim 1 further comprising means for indicating the in phase or out of phase condition of said secondary winding.

7. A suppression circuit as recited in claim 1 wherein said suppression circuit forms part of a change-over device for slide projectors.

* * * * *